US009743778B2

(12) United States Patent
Garritt

(10) Patent No.: US 9,743,778 B2
(45) Date of Patent: Aug. 29, 2017

(54) ERGONOMIC INFANT CARRIER

(71) Applicant: BOX LIMITED, Douglas (IM)

(72) Inventor: James Garritt, Douglas (IM)

(73) Assignee: BOX LIMITED, Douglas (IM)

( * ) Notice: Subject to any disclaimer, the term of this patent is extended or adjusted under 35 U.S.C. 154(b) by 65 days.

(21) Appl. No.: 14/770,662

(22) PCT Filed: Feb. 6, 2014

(86) PCT No.: PCT/GB2014/050342
§ 371 (c)(1),
(2) Date: Aug. 26, 2015

(87) PCT Pub. No.: WO2014/132030
PCT Pub. Date: Sep. 4, 2014

(65) Prior Publication Data

US 2016/0000233 A1 Jan. 7, 2016

(30) Foreign Application Priority Data

Feb. 26, 2013 (GB) ..... 1303361.8

(51) Int. Cl.
*A47D 13/02* (2006.01)

(52) U.S. Cl.
CPC ..... *A47D 13/02* (2013.01)

(58) Field of Classification Search
CPC ..... A47D 13/02; A47D 13/025
USPC ..... 224/158–161
See application file for complete search history.

(56) References Cited

U.S. PATENT DOCUMENTS 4,717,056 A * 1/1988 Carmichael ..... A47D 13/02 2/69.5
5,267,680 A * 12/1993 Torok ..... A47D 13/02 224/158
6,056,355 A * 5/2000 Klassen ..... A47D 15/00 297/184.1

(Continued)

FOREIGN PATENT DOCUMENTS

WO 2006065332 6/2006

OTHER PUBLICATIONS

International Search Report dated May 22, 2014 for corresponding PCT Application No. PCT/GB2014/050342, International Filing Date Feb. 6, 2014.

(Continued)

*Primary Examiner* — Corey Skurdal
(74) *Attorney, Agent, or Firm* — A. C. Entis-IP Ltd.

(57) ABSTRACT

An ergonomic infant carrier comprises a contoured shell having a non-planar base and contiguous perimeter side wall upstanding from the base. At least one carrying strap which is attached or attachable to the contoured shell is also provided. The base includes a bottom portion, a head portion extending from a first end of the bottom portion, and a foot portion extending from a second end of the bottom portion opposite the first end. The head and foot portions extend upwardly from the bottom portion to meet the side wall, and the bottom portion has a width which is less than that of the head and foot portions. The reduced width enables the side wall to define a waisted portion partway along the longitudinal extent of the infant carrier to accommodate a side of a carer. A method of preparing an ergonomic infant carrier is also provided.

18 Claims, 3 Drawing Sheets

(56) References Cited

U.S. PATENT DOCUMENTS

| | | | | |
|---|---|---|---|---|
| 6,354,475 | B1 * | 3/2002 | Grace | A47D 13/02 224/158 |
| D506,322 | S * | 6/2005 | Owen | D6/333 |
| 8,960,794 | B2 * | 2/2015 | St. Pierre | A47D 13/02 297/219.12 |
| 2005/0110315 | A1 * | 5/2005 | Littlehorn | B60N 2/26 297/219.12 |
| 2006/0138826 | A1 | 6/2006 | Caton et al. | |
| 2009/0114691 | A1 * | 5/2009 | Bizzell | A47D 13/02 224/577 |
| 2010/0051658 | A1 * | 3/2010 | Parness | A47D 13/02 224/158 |
| 2011/0062752 | A1 * | 3/2011 | Kho | A47D 1/10 297/130 |

OTHER PUBLICATIONS

Great Britain Search Report dated May 31, 2013 for corresponding GB Application No. GB1303361.8, Filing Date Feb. 26, 2013.

* cited by examiner

ERGONOMIC INFANT CARRIER

RELATED APPLICATIONS

The present application is a US National Phase of PCT Application No. PCT/GB2014/050342, filed on Feb. 6, 2014, which claims the benefit under 35 U.S.C. §119(a)-(d) of British Application GB 1303361.8 filed on Feb. 26, 2013, the disclosures of which are incorporated herein by reference.

The present relates to an ergonomic infant carrier and to a method of preparing such an infant carrier.

Infant or baby carriers are known, and are presently becoming more complex as multi-functionality is being incorporated. For example, it is known to provide a baby carrier that doubles as a car seat and which can also be mounted to a wheeled chassis to form a pram, pushchair or stroller.

However, such arrangements are hugely expensive, due to requiring multiple moving parts and having to meet rigorous safety standards.

Furthermore, traditional baby carriers are known which are only intended to function as holders enabling a parent or carer to carry the device from one location to another before then removing then relocating the baby as required. A traditional baby carrier is a typically boxed-sided container having a flat base and flat walls which extend upwardly from the flat base. Although padded material may be included within the boxed-sided container, such a carrier does not conform or support the child therewithin, and this can lead to discomfort over time.

Additionally, such a traditional baby carrier is adapted to the person carrying the device, and again this can lead to discomfort for the carer over time.

The present invention therefore seeks to provide a solution to these problems.

According to a first aspect of the invention, there is provided an ergonomic infant carrier comprising a contoured shell having a non-planar base and contiguous perimeter side wall upstanding from the base; and at least one carrying strap attached or attachable to the contoured shell; the said base having a bottom portion, head portion extending from a first end of the bottom portion and a foot portion extending from a second end of the bottom portion opposite the first end, the head and foot portions extending upwardly from the bottom portion to meet the side wall, the bottom portion having a width which is less than that of the head and foot portions whereby the side wall defines a waisted portion partway along the longitudinal extent of the infant carrier for accommodating a side of a carer.

According to a second aspect of the invention, there is provided a method of preparing an ergonomic infant carrier in accordance with the first aspect of the invention, the method comprising the steps of: a] selecting one from amongst a plurality of different complementarily-shaped outer covers and applying the selected outer cover to the contoured shell of the infant carrier; and b] selecting one from amongst a plurality of different waisted conformable liners and engaging the selected liner with the interior surface of the non-planar base of the contoured shell.

The invention will now be more particularly described, by way of example only, with reference to the accompanying drawings, in which.

Figure 1:
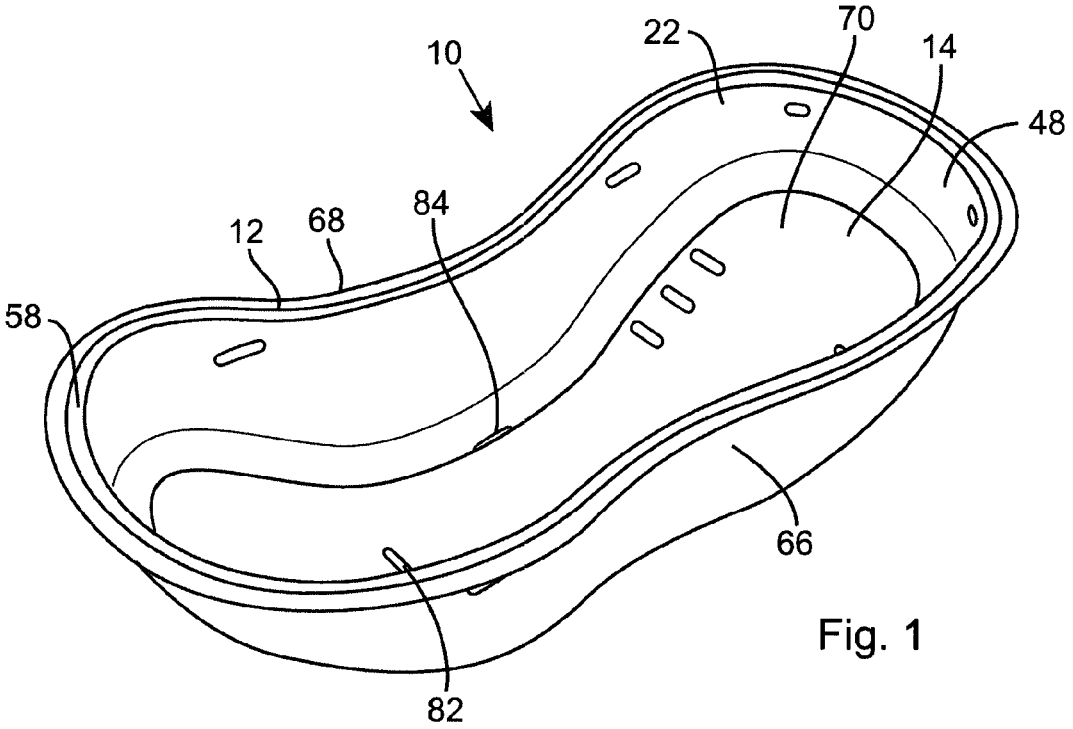
FIG. 1 shows a perspective view of one embodiment of an ergonomic infant carrier, in accordance with the present invention.
Figure 2:
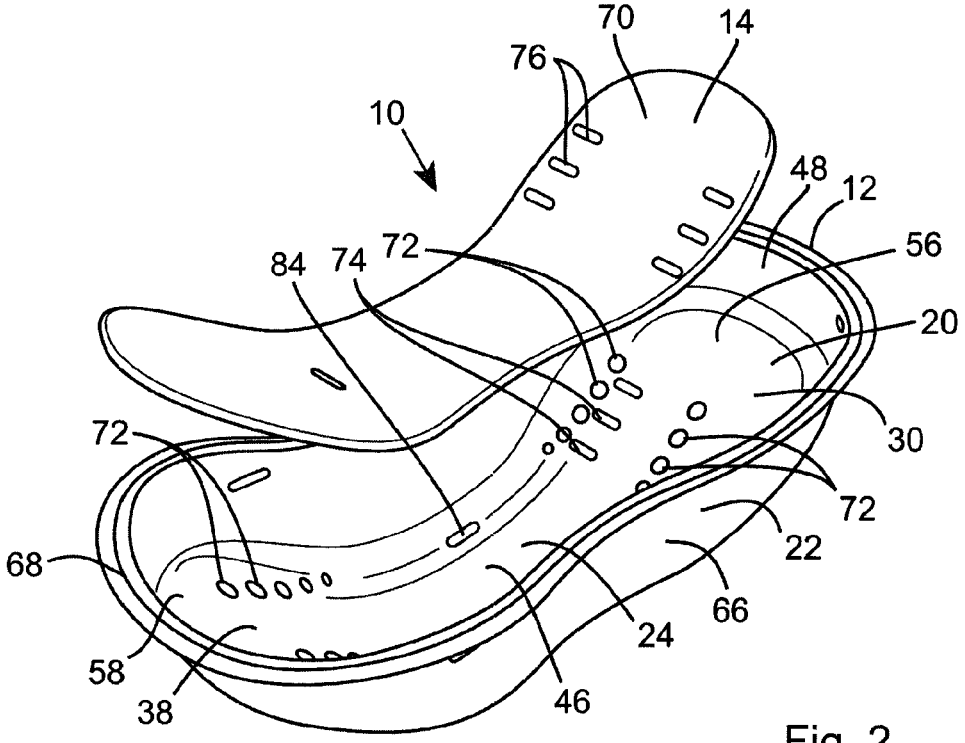
FIG. 2 is an exploded perspective view of the ergonomic infant carrier.

Referring to the drawings, there is shown an ergonomic infant carrier 10 which comprises a contoured shell 12, a liner 14, an outer cover 16 and a carrying strap 18. The contoured shell 12 is preferably a rigid one-piece plastics moulding having a non-planar base 20 and a contiguous perimeter side wall 22 which extends upwardly from a perimeter edge of the non-planar base 20.

The base 20 includes a bottom portion 24 for receiving a buttock region 26 of an infant 28, a head portion 30 for supporting a torso 32, shoulders 34 and head 36 of the infant 28, and a foot portion 38 for supporting the legs 40 and feet 42.

An exterior surface 44 of the bottom portion 24 of the base 20 is preferably substantially flat or planar, or may include rails or feet to enable support without rocking due to movement of the child 28 being carried.

An interior surface 46 of the bottom portion 24 is also preferably flat in the longitudinal direction of the shell 12, and flat or slightly concave in the lateral direction in order to support the buttock region 26 of the child 28.

The head portion 30 extends generally upwardly from a first end of the bottom portion 24 to meet the side wall 22 at a head end 48 of the shell 12, and is preferably arcuate in at least a longitudinal direction of the shell 12, whereby a smooth reversed S-curve or sine wave is defined. Beneficially, in this case, the head portion 30 may initially curve slightly upwardly from the bottom portion 24 to support a lower lumbar region 50 of a child 28, recurve in an opposite direction to provide a shoulder support portion 52, and then recurve again back in the original direction to provide a head support portion 54 for the back of a child's head 36, before finally meeting the side wall 22 at the head end 48 of the shell 12.

In a lateral direction, it may also be beneficial that an interior surface 56 of the head portion 30 is slightly concave. In this case, it may be beneficial to have two slightly concave portions either side of a slightly convex portion midway therebetween. In this configuration, this would provide an undulating sine curve or W-shaped lateral extent. This may be beneficial in support the child's shoulder blades in the concave portions whilst supporting the child's vertebral region on the central convex portion.

The foot portion 38 also extends generally upwardly from a second end of the bottom portion 24 to meet the side wall 22 at a foot end 58 of the shell 12. The foot portion 38 is preferably curved in at least the longitudinal direction of the shell 12, providing a smoothly contoured reversed S-curve or sine wave between the bottom portion 24 and the side wall 22 at the foot end 58. To better support a child's legs 40 and feet 42, the foot portion 38 preferably curves slightly upwardly from the bottom portion 24 to provide a hamstring support portion 60, and then recurves in an opposite direction to provide a calf support portion 62. In this way, loading is removed from the knee area of the child 28, whereby the leg 40 is supported in a slightly bent condition such that the knee 64 is unlocked.

The bottom portion 24 has a side-to-side width which is less than that of both the head portion 30 and the foot portion 38. In this way, the side wall 22 defines a waisted portion 66 partway or generally midway between the head end 48 and the foot end 58 of the shell 12. The waisted portion 66 is adapted to accommodate a carer's waist or hip if using a shoulder carrying strap, or a carer's thigh or lower leg if using carrying handles.

Additionally, it is preferable that the side wall 22 diverges slightly from the perimeter of the base 20 to the rim 68 of the shell 12. This again helps to support a child 28 therewithin, and prevents or limits excessive side to side movement.

To further support the child 28 within the infant carrier 10, the aforementioned liner 14 is provided. The liner 14 is conformable and, in this case, may conveniently be an elastically deformable mat 70. The mat 70 is complementarily-shaped to match or substantially match the base 20, and is connectable thereto to at least prevent or limit unintentional removal.

Figure 3:
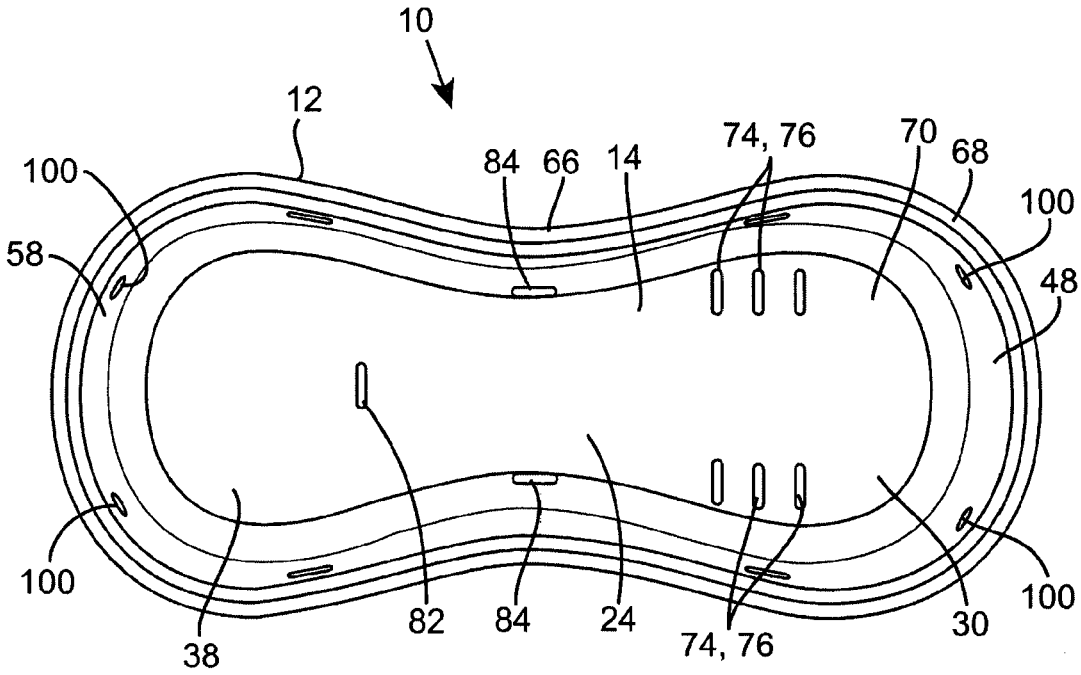
FIG. 3 is a top plan view of the ergonomic infant carrier.
Figure 4:
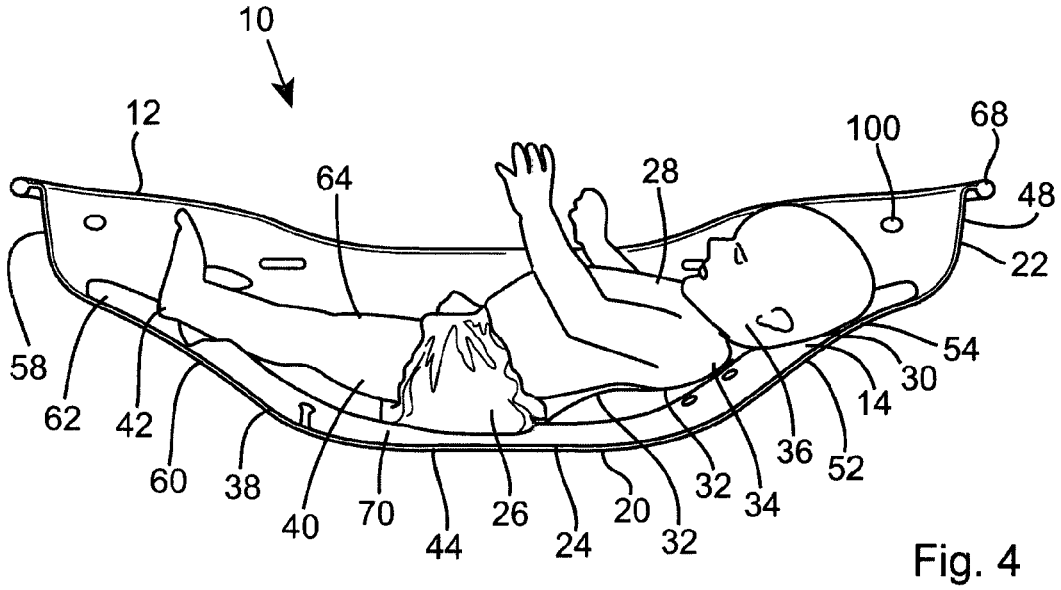
FIG. 4 is a longitudinal cross-sectional side view of the in use ergonomic infant carrier.
Figure 5:
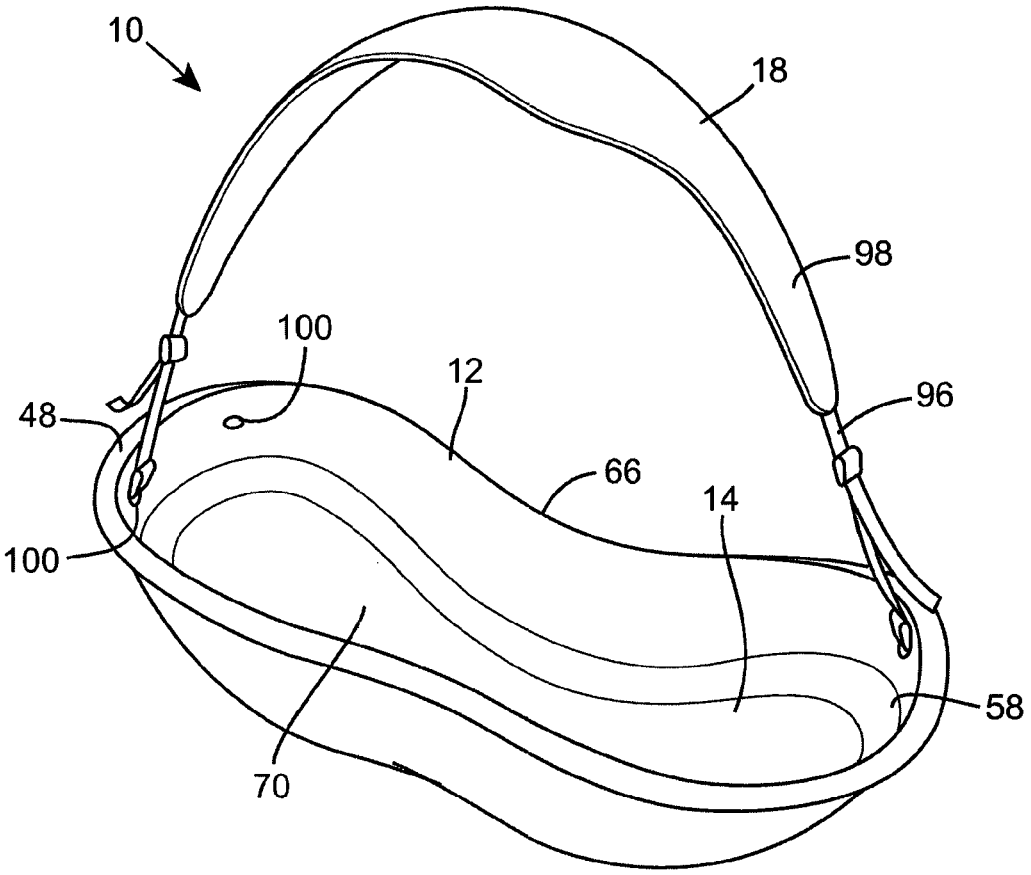
FIG. 5 is another perspective view of the ergonomic infant carrier, this time showing a removable cover and first carrying straps.
Figure 6:
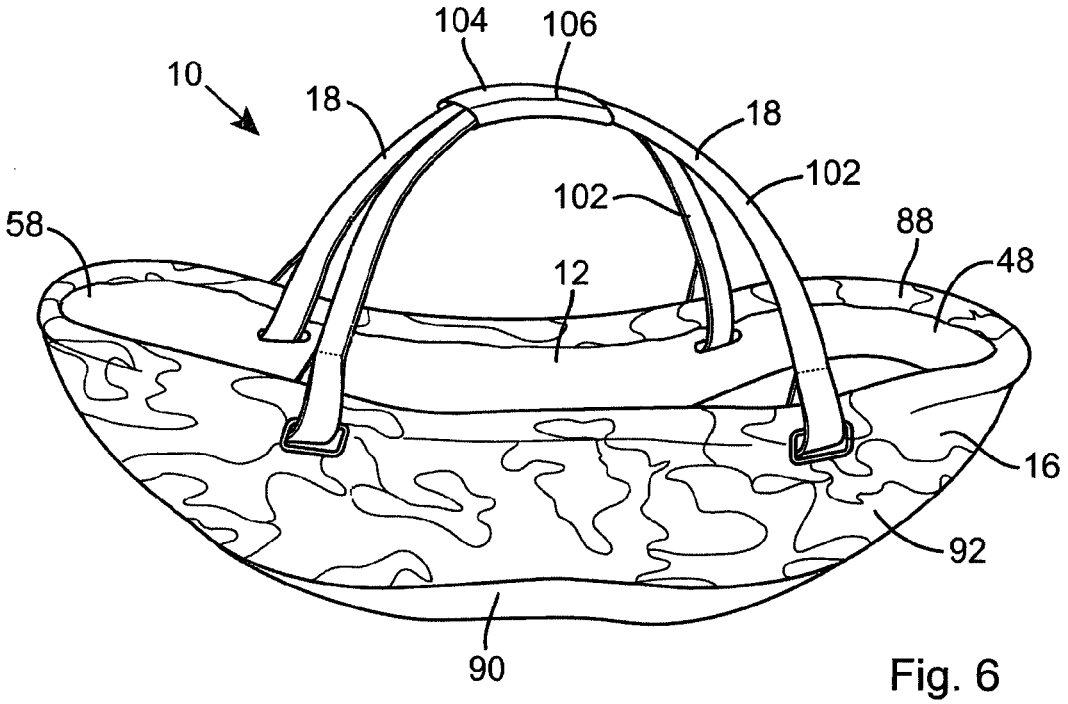
FIG. 6 is a further perspective view of the ergonomic infant carrier, showing a second carrying strap.

The liner mat 70 may be permanently affixed to the interior surface 46 of the base 20, or more conveniently may be releasable. In this latter case, one or more retainers are preferably utilised, and these may be push-fit or snap-fit fasteners which engage with openings 72, in this case being apertures, in the base 20. To engage the liner mat 70 with the base 20, any suitable engagement means may be utilised, as preferably as shown in FIG. 3, openings 72 may be provided at the head portion 30 and at the foot portion 38.

It may also be beneficial to provide the shell 12 with one or more harness connectors 74. In this case, the shell 12 and the liner mat 70 include corresponding harness slots 76, and these are provided as two spaced-apart parallel rows of harness slots 76 at the shoulder support portion 52 of the base 20. A further harness connector 82 is provided in the vicinity of the juncture between the bottom portion 24 and the foot portion 38, and this further harness connector 82 is preferably centrally disposed to align or substantially align with a groin region of the child 28. Appropriate harness straps can thus be threaded through the respective slots in the shell 12 and the mat 70 as required.

The plurality of first said harness connectors 74 at the shoulder region of the base 20 is advantageous in accommodating growth of the child 28, and thus repositioning of the harness straps. However, only one harness slot need be provided on each side, if indeed a harness is to be utilised at all.

Although only one further harness connector 82 is shown in the drawings, again, a row of further harness connectors may be provided in order to accommodate growth of the child 28 or indeed different children.

It may also be advantageous to optionally provide waist-belt connectors 84 at or adjacent to sides of the bottom portion 24. In this case, the waist-belt connectors 84 are slots formed within the base 20 and spaced slightly outboard of the liner 14. A suitable waist belt can thus be threaded through the waist-belt connector slots 86, and buckled across a waist of the child 28 in the shell 12.

Although the connectors so far described are slots, other mountings may be considered and utilised, such as eyelets or threaded fasteners.

Preferably, the liner 14 is one of a plurality of different liners 14 which can be selected from depending on the child 28. Beneficially, the liners 14 have different exterior appearances, such as different colours, and thus a parent or carer can choose a most appropriate liner 14.

Additionally or alternatively, the padding of the liner 14 may vary between the plurality of different liners 14, allowing the parent or carer to select the most appropriate liner 14 to suit the shape, weight and size of their child 28.

By making the liner 14 removable, should the liner 14 be soiled, then it can be removed and cleaned, or disposed of and replaced. In any event, the liner 14 is preferably formed of a liquid-resistant material, allowing it to be wiped down as required.

The outer cover 16 is complementarily shaped to receive the contoured shell 12 as a close or tight fit. Preferably, the outer cover 16 has an elasticated rim band 88 which allows engagement of the outer cover 16 over the rim 68 of the shell 12. The rim 68 of the shell 12 may be slightly contoured, for example, including an undercut at or adjacent to the rim 68 in the interior surface 46, thereby receiving the rim band 88 and preventing or limiting the chance of unintentional disengagement.

Although elasticated, the rim band 88 may additionally or alternatively have a drawstring and/or any other suitable engagement means, such as push-fit fasteners.

The outer cover 16 preferably includes a resilient base portion 90 and an aesthetic body portion 92 extending from the base portion 90. The resilient base portion 90 is intended to overlie and preferably overlap an exterior surface 44 of the bottom portion 24 of the base 20. The resilient base portion 90 provides a tough, hard-wearing surface in comparison to the generally less heard-wearing aesthetic body portion 92. As such, the resilient base portion 90 may be formed from, for example, rip stop fabric or canvas, or other suitable woven or non-woven, typically synthetic, material.

Preferably, the outer cover 16 is one of a plurality of different outer covers 16 which can be selected from depending on the child 28. The outer covers 16 may have different exterior appearances, such as different colours, and thus a parent or carer can choose a most appropriate liner 14.

By also making the outer cover 16 removable, should the cover 16 become soiled, then it can be removed and cleaned, or disposed of and replaced.

Furthermore, the removable outer cover 16 may have varying thermal or insulative characteristics, allowing the parent or carer to change it dependent on the environmental conditions. For example, in winter, an outer cover 16 which is more thermally insulating may be chosen to help isolate the child 28 therewithin from the cold. Alternatively, in summer, a lighter or thinner outer cover 16 may be chosen to aid in preventing the child 28 from overheating.

The above described carrying strap 18 may be a single, preferably length adjustable, shoulder strap 96 formed of flexible fabric or plastics and which, in this case, may include a padded shoulder element 98 extending at least partway therealong. To provide for carrying on either side of a parent or carer, at least two spaced apart engagement points 100 may be provided, offset relative to a central longitudinal axis of the shell 12, at the head end 48 and the foot end 58.

Additionally or alternatively, two said carrying straps 18 may be provided at opposing longitudinal side wall portions, in this case being flexible elongate handles 102 which preferably include grips 104 partway and typically midway therealong for a user to grasp.

Optionally, at least one of the grips 104 may include a connector 106, such as an unfurlable strip portion, which can be wrapped around the other grip and then reattached to itself, such as be the use of a hook and loop fastener, to interengage the two grips 104. Other releasable connectors can be considered, however, such as push-fit or snap-fit fasteners.

Although not length adjustable in this embodiment, the handles may be length adjustable as required. Furthermore, the or each strap may be permanently attached to the shell, for example, by stitching or riveting each handle to itself in a looped fashion through engagable apertures in the shell, or may be removably engagable for example by the use of buckles or hook and loop fasteners, as necessity dictates.

The advantage of using flexible straps is that the carrier hangs from the carer naturally under the effects of gravity unlike a carrier having a rigid strap. To facilitate the natural hang of the carrier, the straps are connected to the carrier preferably using a looped means as described above, permitting a wider range of hanging positions to be adopted. Hinged joints are undesirable, as the shell will be held in an unstable or non-level position if the strap is not correctly held by the carer.

The or each carrying strap may be integrally formed as part of the shell. However, it is preferable that the carrying strap is releasable to enable reconfiguration as required.

Whilst the contoured shell is described as preferably being formed from a rigid one-piece plastics moulding, alternatively, the contoured shell could be formed from a semi-rigid material, for instance a rigidly flexible plastics material, or a rigid hard-wearing cloth. The shell could alternatively be moulded in two parts; the main portion of the shell being rigid moulded plastics, with a smaller portion, for instance the waisted portion, being moulded from a more flexible material, for instance, a thermoplastic elastomer.

Utilising a semi-rigid contoured shell will allow the waisted portion to conform slightly to the side of the carer, which allows the carrier to be used by carers of varying body shapes and sizes without resulting in discomfort to the waist and or legs of the carer. The contoured shell must remain at least partially rigid however, to avoid deforming the waisted portion of the carrier so much as to discomfort the transported infant.

A semi-rigid contoured shell may also allow for some conformability of the area surrounding the transported infant. Conformability allows the contoured shell to adapt to the infant as it changes position within the carrier, the carrier providing adequate support to the infant whilst also maintaining a comfortable resting position.

This deformation in response to the positioning of the infant could either be achieved by utilising a semi-rigid material for the contoured shell, or by using a thermally deformable plastics material which can reversibly deform when exposed to the natural bodily warmth of the infant.

It is thus possible to provide an ergonomic infant carrier which better accommodates both the child to be transported as well as the parent or carer carrying the device. By providing a waisted region, the child is more snugly and therefore securely retained within the carrier, and the side or leg of the carer is more comfortably receivable. The infant carrier is also customisable to the preference of the carer, allowing a more bespoke appearance. Furthermore, it is possible to provide greater or lesser thermal insulation to the shell by the removable outer cover with hard-wearing resilient base, along with greater or lesser padding of the liner depending on the infant to be transported. The rigid one-piece shell is not only simple to manufacture and therefore cost-effective to produce, but also robust thus improving longevity.

The embodiments described above are provided by way of examples only, and various other modifications will be apparent to persons skilled in the field without departing from the scope of the invention as defined herein.

The invention claimed is:

1. An ergonomic infant carrier comprising a contoured shell having a non-planar base and contiguous perimeter side wall upstanding from the base; at least one carrying strap attached or attachable to the contoured shell; and a complementarily-shaped outer cover which receives the contoured shell, the outer cover being engagable with a rim of the contoured shell, the base having a bottom portion, a head portion extending from a first end of the bottom portion, and a foot portion extending from a second end of the bottom portion opposite the first end, the head and foot portions extending upwardly from the bottom portion to meet the side wall, the bottom portion having a width which is less than that of the head and foot portions whereby the side wall defines a waisted portion partway along the longitudinal extent of the infant carrier to accommodate a side of a carer, and the outer cover comprising a resilient base portion and an aesthetic body portion which extends from the base portion, the base portion overlying an outer surface of the bottom portion of the non-planar base to provide a hard-wearing ground contact surface.

2. The ergonomic infant carrier as claimed in claim 1, further comprising a waisted conformable liner which lines an interior surface of the non-planar base.

3. The ergonomic infant carrier as claimed in claim 2, wherein the waisted conformable liner is releasably fastenable to the interior surface of the non-planar base.

4. The ergonomic infant carrier as claimed in claim 3, further comprising at least one non-permanent releasable retainer which engages the waisted conformable liner with the non-planar base.

5. The ergonomic infant carrier as claimed in claim 4, wherein the retainer is a push-fit fastener.

6. The ergonomic infant carrier as claimed in claim 2, wherein a plurality of the waisted conformable liners is provided, the waisted conformable liners being different and selectably interchangeable with each other.

7. The ergonomic infant carrier as claimed in claim 1, further comprising at least one harness connector in or on the contoured shell.

8. The ergonomic infant carrier as claimed in claim 7, wherein at least three said harness connectors are provided, each harness connector being a slot provided at or adjacent to the non-planar base, two said slots being provided at or adjacent to the head portion of the base and one said harness connector being at or adjacent to the foot portion.

9. The ergonomic infant carrier as claimed in claim 8, wherein two rows of slots at the head portion are positioned to provide harness adjustability, and one row of slots is provided at the foot portion.

10. The ergonomic infant carrier as claimed in claim 1, wherein the resilient base portion and the aesthetic body portion have different wear characteristics.

11. The ergonomic infant carrier as claimed in claim 1, wherein a plurality of the outer covers is provided, the outer covers being different and selectably interchangeable with each other.

12. The ergonomic infant carrier as claimed in claim 11, wherein each said different outer cover has a different level of thermal insulation.

13. The ergonomic infant carrier as claimed in claim 1, wherein two said carrying straps are provided, each strap being releasably connectable to a side wall of the non-planar base and each strap including a hand grip adapted to carrying the infant carrier by hand.

14. The ergonomic infant carrier as claimed in claim 13, wherein the hand grips are releasably interengagable with each other.

15. A method of preparing the ergonomic infant carrier as claimed in claim 1, the method comprising the steps of: a] selecting one from amongst a plurality of different complementarily-shaped outer covers and applying the selected outer cover to a contoured shell of the infant carrier ; and b] selecting one from amongst a plurality of different waisted conformable liners and engaging the selected liner with an interior surface of a non-planar base of the contoured shell .

16. The method as claimed in claim 15, further comprising a step c] of selecting at least one from amongst a plurality of different carrying straps and connecting the selected carrying strap to the outer shell.

17. The method as claimed in claim 15, wherein the plurality of complementarily-shaped outer covers and/or the plurality of different waisted conformable liners have different exterior appearances.

18. An ergonomic infant carrier comprising a contoured shell having a non-planar base and contiguous perimeter side wall upstanding from the base; at least one carrying strap attached or attachable to the contoured shell; the base having a bottom portion, a head portion extending from a first end of the bottom portion and a foot portion extending from a second end of the bottom portion opposite the first end, the head and foot portions extending upwardly from the bottom portion to meet the side wall, the bottom portion having a width which is less than that of the head and foot portions whereby the side wall defines a waisted portion partway along the longitudinal extent of the infant carrier to accommodate a side of a carer; and a plurality of different selectably interchangeable complementarily-shaped outer covers which receive the contoured shell; each said outer cover includes a resilient base portion and an aesthetic body portion which extends from and has different wear characteristics to the base portion, the base portion overlying an outer surface of the bottom portion of the non-planar base to provide a hard-wearing ground contact surface.

* * * * *